United States Patent [19]

Nidola et al.

[11] Patent Number: 5,015,344

[45] Date of Patent: May 14, 1991

[54] ELECTRODES WITH DUAL POROSITY

[75] Inventors: Antonio Nidola; Gian N. Martelli, both of Milan, Italy

[73] Assignee: Oronzio deNora Impianti Elettrochimici S.p.A., Milan, Italy

[21] Appl. No.: 181,406

[22] Filed: Apr. 13, 1988

Related U.S. Application Data

[63] Continuation-in-part of Ser. No. 78,517, Jul. 27, 1987, abandoned.

[30] Foreign Application Priority Data

Jul. 28, 1986 [IT] Italy ..... 21278 A/86

[51] Int. Cl.[5] ..... C25B 11/03; C25B 11/06; C25B 1/26

[52] U.S. Cl. ..... 204/98; 204/128; 204/129; 204/252; 204/266; 204/283; 204/290 R; 204/291; 204/292

[58] Field of Search ..... 204/283, 98, 128, 252, 204/266, 129, 290 R, 291–292

[56] References Cited

U.S. PATENT DOCUMENTS

| | | | |
|---|---|---|---|
| 4,191,618 | 3/1980 | Coker et al. | 204/283 |
| 4,293,394 | 10/1981 | Darlington | 204/125 |
| 4,421,579 | 12/1983 | Covitch et al. | 204/290 R |
| 4,465,570 | 8/1984 | Oda et al. | 204/129 |
| 4,469,579 | 9/1984 | Covitch et al. | 204/296 |
| 4,496,437 | 1/1985 | McIntyre et al. | 204/24 |
| 4,536,259 | 8/1985 | Oda et al. | 204/35.1 |
| 4,568,441 | 2/1986 | Covitch et al. | 204/283 |
| 4,661,218 | 4/1987 | Oda et al. | 204/98 |

*Primary Examiner*—John F. Niebling
*Assistant Examiner*—David G. Ryser
*Attorney, Agent, or Firm*—Bierman and Muserlian

[57] ABSTRACT

An electrode comprising a gas permeable and liquid permeable coating bonded to an ion exchange membrane, said coating comprising low overvoltage electrocatalytic particles, more electroconductive electrolyte resistant particles and an electrolyte resistant binder compatible with the membrane to bond the particles thereto, the electrode coating being provided with a plurality of pores with a pore size of at least 0.1 microns.

Effective porosity is imparted to the layer of particles by means of a sacrificial, pore-forming agent and by leaching out such agent after the particles have been bonded together and the layer formed is in its desired thickness, preferably after it has been deposited upon the membrane.

Surface resistivity of the layer is reduced and the layer is effectively reinforced by incorporating electroconductive particles which often have a higher overvoltage than the electrocatalytic particles and also have high electroconductivity. Silver and materials having approximately the equivalent electroconductivity of silver are incorporated for this purpose.

21 Claims, No Drawings

ELECTRODES WITH DUAL POROSITY

PRIOR APPLICATION

This application is a continuation-in-part application of commonly assigned U.S. application Ser. No. 078,517 filed July 27, 1987, now abandoned.

STATE OF THE ART

Membrane electrolyzers have been proposed in which at least one of the electrodes is bonded to one side of the membrane to achieve maximum production with the minimum consumption of electric power. The second electrode may be bonded to the other side of the membrane or may be pressed against such side or even spaced a short distance therefrom.

Such electrolyzers and the relevant electrolysis processes are described for example in U.S. Pat. No. 4,224,121, which describes a bonded electrode comprising a porous coating on one side of the membrane, the coating comprising particles of an electrocatalytic material which is capable of functioning as an inert-to electrolyte electrode material at a relatively low overvoltage in which the particles are bonded together by a binder or polymer capable of resisting attack during use of the coating as an electrode in the electrolytic processes to produce chlorine or hydrogen.

The coating is porous so as to be permeable to electrolyte with which it comes in contact and typical electrode particles used on the cathode side include platinum group metals and their electroconductive oxides. Such coating does not have a satisfactory lifetime.

OBJECTS OF THE INVENTION

It is an object of the present invention to provide novel bonded electrodes, particularly cathodes having a remarkably longer lifetime than conventional bonded electrode.

It is another object of the invention to provide a novel electrolytic cell and method having a lower cell voltage which results in a considerable saving in energy consumption, in the course of electrolysis of alkali metal chloride solutions to produce elemental chlorine and alkali in an electrolyzer.

These and other objects and advantages of the invention will become obvious from the following detailed description.

THE INVENTION

The novel electrodes of the invention are comprised of a gas permeable and liquid permeable layer or coating bonded to an ion exchange membrane; such layer or coating comprising low overvoltage electrocatalytic particles, and an electrolyte resistant binder compatible with the membrane to bond the particles thereto, the electrode layer or coating being provided with a plurality of pores with a pore size of at least 0.1 microns.

Advantageously and preferably the coating or layer also contains enough electroconductive particles or components which differ from the low overvoltage particles and which serve to substantially increase the lateral conductivity (in an edgewise direction), of the layer or sheet or coating whereby they provide more uniform current distribution of current density.

More particularly, according to one embodiment of the invention, improved cathodes may be provided which are constituted by a gas and liquid permeable coating bonded to an ion exchange membrane, said cathode comprising particles of an electrocatalytic, low hydrogen evolution material and a suitable binder capable of resisting attack and holding the layer bonded together and to the surface of the diaphragm and characterized in that it further contains either electroconductive, corrosion resistant particles generally having higher hydrogen overvoltage and often having greater conductivity than the electrocatalytic material, and pores formed by leaching leachable sacrificial pore-forming particles therefrom. The low hydrogen overvoltage, electrocatalytic material is preferably a compound of metals belonging to the platinum metal group. Typical highly electroconductive materials include certain metals such as silver, nickel, cobalt or copper. Silver is found to be especially effective.

Electroconductive compounds, other than pure metals, may also be used in the mixture. These include conductive alloys of copper and nickel, copper and lanthanum etc. wherein the high electrical conductivity of one component (e.g. copper) is associated to the high resistance of the other one (e.g. nickel, lanthanum) and intermetals consisting of carbides of tungsten, molybdenum, silicon and titanium or other valve metal.

Basically, the amount of electroconductor is directed to maintaining or even increasing the electrical conductivity typical of the platinum group metal compounds, while lowering the noble metal load per unit area of electrode surface at which electrolysis takes place. The upper limit for the amount of electroconductor is limited only by the necessity to keep the hydrogen overvoltage of the mixtures below a certain threshold value. As a matter of fact, the typical maximum allowed hydrogen overvoltage of the mixture preferably should be about 0.2 Volts in a 30–35% NaOH solution, at a temperature of 90° C. and at a cathode current density of 1000 Amperes per square meter of cathode surface.

Further, the coating should exhibit a good electrical conductivity so that electric current, supplied by a current distributor which may be a screen, a wire mat or other conductor, may flow through the conductive particles contained in the coating and be distributed to the electrocatalytic particles. Conveniently, the coating is highly porous and permeable to allow for the electrolyte, e.g. the catholyte, flow therethrough so that the electrolysis reaction may take place when the electrolyte comes into contact with the exposed surface of the low overvoltage particles. The preferred pore size is in the range of 0.1 to 10 micron and the preferred degree of porosity is 0.5 to 1 micron.

According to one embodiment of this invention and in order to obtain the necessary porosity, the mixture initially contains a solid leachable material such as aluminum powder or flakes, water soluble inorganic salts or organic compounds, which may be in small crystals or even in the form of needles or strands. After the mixture is bonded to one side of the membrane, the leachable material may be leached from the mixture to produce channels through which catholyte can move to contact the conductive, electrocatalytic particles and the evolved hydrogen can escape.

By recourse to sacrificial agents such as pulverulent or particulate aluminum powder it is possible to provide in the electrode pores or channels of a controlled density shape and size. It will be understood that the electrode mixture of electrocatalytic particles and binder has an inherent porosity due to the fact that said mixture is deposited as a layer or coating and pressed together.

Usually water or some other liquid is present during the coating or layer formation. In that event pores are created as the liquid is vaporized during heating and pressing the layer. Furthermore other pores are formed because the heating and pressure is limited to permit them to be formed in the course of depositing and forming the electrode layer.

By use of the sacrificial agent it is possible to provide in the electrode a further set of pores which:

(a) may be larger than the inherent pores and/or
(b) larger than the electrode particles and/or
(c) larger than the particles or other material used to improve the lateral electroconductivity or reduce the lateral edge to edge surface resistance of the electrode layer.

Pores of this type have the advantage that they provide ready escape of evolved hydrogen or other gas at the surfaces of the electrode particles. This avoids or reduces the likelihood of damage to the electrode as evolved gas accumulates as well as of preventing or reducing undesirably high voltage between the electrodes in local areas with consequent objectionable variations in current density distribution over the entire active area of the electrode.

Furthermore since the sacrificial or leachable agent is extracted from the electrode layer after its formation these pores or channels initiate at the outer surface of the electrode layer and penetrate into the depth or even entirely through the electrode and readily communicate with the inherent pores. This permits passage of gas and electrolyte therethrough to and from such inherent or natural pores of the electrode.

Average diameter of the leachable or extractable material such as aluminum powder often and preferably is equal to at least one tenth to one half the thickness of the electrode area. Where these particles are in the form of wires or strands they may extend laterally in a direction substantially parallel to and between the surfaces of the electrode. In that case the channels created by their extraction may often run in and edgewise direction for some distance under the surface of the electrode layer.

A suitable binder, resistant to the aggressive cell environment, is used to obtain an adequate bonding. Preferred binders include processable polymers of organic monomers which on polymerization form a carbon chain and which have fluorine attached to the chain often to the substantial exclusion of other radicals or in any event as the preponderant radical attached thereto. Such materials include polymers of tetrafluoroethylene and/or chlorotrifluoroethylene and similar polymers which may also contain cation exchange groups. Furthermore the binder may be the same or substantially the same composition as the membrane to which it is bonded.

The mixture may be heated and fused or sinterized to cement the particles together. Alternatively a solution or slurry or suspension of such polymer in a liquid may be mixed with the low overvoltage particles and the conductor particles and the mixture dried and treated to produce a self sustaining sheet or a suitable coating on the diaphragm. When a separate sheet is produced the sheet may be bonded to the diaphragm in a second manufacturing step.

The particles of the conductor as well as the particles of the low overvoltage material may be in any convenient shape or size which may be distributed throughout the binder to provide substantially uniform conductivity and overvoltage over the entire surface thereof from end to end or side to side. Conveniently the conductor as well as the low overvoltage material may be in the form of a powder. Alternatively either or both of the particles may be in the form of elongated particles such as threads, wires, strands or the like having a length substantially greater than their cross section.

The structure of the electrodes of the present invention, as well as the materials and the manufacturing procedure utilized for producing the same are illustrated in detail in the following description.

It is an object of the present invention to provide for an electrode, particularly a cathode, bonded to an ion exchange membrane or diaphragm, which is characterized by an improved operating voltage compared with conventional electrodes, and further a longer active lifetime.

The ion exchange membrane or diaphragm, to which the electrode is bonded, is constituted by a thin sheet of a hydrated cation exchange resin characterized in that it allows passage of positively charged ions and it minimizes passage of negative charged ions, for example passing $Na+$ and minimizing passage of $Cl-$ respectively. Two classes of such resins are particularly known and utilized; in the first one the ion exchange groups are constituted by hydrated sulphonic acid radicals attached to the polymer backbone or carbon-carbon chain, whereas in the second one the ion exchange groups are carboxylic radicals attached to such chain or backbone. As it is well known, the best preferred resins for industrial applications, (such as the electrolysis of alkali metal halides, alkali metal hydroxide due to their higher chemical resistance to the electrolytes, are obtained by utilizing fluorinated polymers.

When utilizing fluorinated cationic membranes in industrial applications, a higher electrical conductivity has been obtained by increasing the number of sulphonic or carboxylic radicals attached to the polymer backbone: these membranes, which permit reduction of the cell voltage, are defined as "low equivalent weight membrane". However, these membranes are strongly hydrated and architectonically opened and thus a remarkable and undesirable diffusive migration of catholyte, for example alkali hydroxides, from the cathode side to the anode side, may be experienced with the consequent reduction of the electrolysis current efficiency.

An efficient inhibition of the catholyte migration, e.g. alkali hydroxide, is achieved by utilizing high equivalent weight membranes, that is membranes having a relatively small number of ion exchange groups attached to the polymer backbone. These membranes, however, exhibit a low electrical conductivity and cause a remarkable increase of the cell voltage.

The above drawbacks have been overcome in industrial applications by combining the two types of membranes into a single membrane wherein the surface in contact with the catholyte, e.g. alkali hydroxide, in the cathode compartment, is constituted by a thin resin layer having high equivalent weight (for example a thickness of 50 microns) bonded to a thicker layer (for example having a thickness of 200 microns) constituted by low equivalent weight resin, in contact with the anolyte (for example alkali metal halide) in the anode compartment.

Said bilayer membranes, when used in conventional cells of the state of the art (e.g. the so-called zero-gap system wherein the electrode is in contact with the membrane, and the so-called finite-gap cells wherein the electrode is spaced from the membrane) must exhibit a sufficient mechanical resistance: This may be obtained by inserting inside the membrane a reinforced fabric, by dispersing fibers of a suitable length inside the polymer or by a combination of both.

Further, the membrane surface may be coated by a thin layer of hydrophilic material, such as metal oxides, e.g. SiO2, TiO2, ZrO2 or other suitable material to avoid or reduce adhesion to its surface by gas bubbles, especially hydrogen gas bubbles evolved in the course of the electrolysis. Ion exchange membranes exhibiting the above mentioned characteristics are produced by Du Pont under the trade mark of Nafion(R) (e.g. Nafion 954, 961) and by Asahi Glass under the trade mark of Flemion(R) (e.g. Flemion 783).

The use of at least one electrode bonded to a cation exchange membrane permits use of other types of membranes with respect to conventional membranes. Example of such other membranes which may be utilized are characterized by a) absence of the hydrophilic layer, whose role is efficiently played by the electrode bonded to the membrane, and b) absence of reinforcing fabric or dispersed fibers and consequently reduced overall thickness, as the electrode bonded to the membrane provides for a high mechanical resistance.

The development of a reliable, industrially applicable technology for bonding at least one electrode to a cation exchange membranes allows to utilize low cost and low voltage drop membranes, which turns out in an appreciable energy saving, as it will be clearly illustrated in the following examples.

Suitable membranes are produced by Du Pont, for example bilayer membranes type NX10119, having an overall thickness of 150 microns. Diaphragms of other constructions including those having coatings of other construction or composition as part of the diaphragm structure may be used in the electrolytic process of this invention.

The electrode advantageously comprises a porous layer of low hydrogen overvoltage particles, conductor particles, strands or the like to improve or maintain conductivity and the binder to bond together the conductor and low hydrogen overvoltage material to produce porous layer electrodes. To insure adequate porosity, a leachable pore-forming material is added and leached out after the layer has been formed or deposited.

The components of the mixture utilized for producing the electrodes are characterized as follows. The binder is constituted of a resin resistant to the electrolyte attack and at least partially compatible with the material constituting the ion exchange membrane and suitable binders are constituted by polytetrafluoroethylene particles. The preferred formulation is an aqueous solution, or emulsion or suspension of such particles. Similar results have been obtained by utilizing Du Pont (Teflon T-30) and Montefluos-Italy (Algoflon D-60) products which are both constituted by very thin particles of polytetrafluoroethylene in the range of 0.1-1 microns, stabilized in an aqueous medium, by adding suitable dispersing agents.

Appreciable results can also be obtained with other fluorinated polymers particles, for example copolymers of tetrafluoroethylene-hexafluroropropene, polyvinyldenfluoride, polyvinylfluoride, polytetrafluoroethylene containing ionic ion exchange groups attached to the polymer backbone, such as sulphonic radicals or carboxylic radicals.

The conductor particles are finely divided particles ranging from about 0.5 to 20 micron. frequently they are substantially spheroidal and have the following characteristics:

| Type | Preparation Method or availability | Granulometry (micron) | Specific surface area (BET) |
|---|---|---|---|
| Copper | reduction by formaldehyde | 1 | 1 m2/g |
| Nickel | reduction by NaBH4 | 1-10 | 1 m2/g |
| Silver | NaBH4 | 1 | 1 m2/g |
| Silver | commercial (Johnson & Matthey) | 1 | 1 m2/g |
| Copper-Nickel | commercial (Heraeus) | 1-5 | 1 m2/g |
| WC | commercial (Union Carbide) | 1 | 10 m2/g |

All of such conductors serve to maintain and to improve the overall electroconductivity of the electrode. Thus, the conductor particles have a surface exposed to contact with the low overvoltage particles (i.e. the electrocatalyst) which surface is highly electroconductive. For example a conductor such as silver particles, has substantially greater electroconductivity than ruthenium oxide or other platinum group oxide or compound. Consequently silver improves the overall electroconductivity of the electrode layer (particularly from edge to edge). Similar results are achieved with other conductors such as copper or nickel metal.

According to one embodiment of the invention, a very thin and fine conductive metal screen, for example having a mesh number higher than 50, is utilized as current conductor. For example, a nickel or preferably a silver screen may be pressed against or event bonded to the ion exchange membrane, to which a layer or coating of a mixture of a fluorinated binder, low hydrogen overvoltage electrocatalytic components and leachable components (for example aluminum powder), has been previously applied. The membrane-coating-conductive screen assembly is then subjected to heating, under pressure, for carrying out the sinterization treatment, as illustrated hereinafter, and then to a leaching treatment. In a further embodiment, the conductive screen may optionally be coated by a metal or a metal compound belonging to the platinum group, or by a compound such a Raney nickel or the like.

The low overvoltage material may include materials such as listed in the following table:

| Type | Production Method or availability | Granulometry | Specific surface area (BET) |
|---|---|---|---|
| Platinum Black | commercial | — | — |
| Platinum black | Adams method(*) | 1 micron | 90 m2/g |
| Pt—Ag Alloys | Thermal decomposition of complex ammino salts | 1-5 micron | 30 m2/g |

-continued

| Type | Production Method or availability | Granulometry | Specific surface area (BET) |
|---|---|---|---|
| | followed by mechanical crushing | | |
| RuO2 | Adams method(*) | 1 micron | 80 m2/g |
| RuO2 | Thermal decomposition of RuCl3, followed by mechanical hashing(**) | 1-5 micron | 1.5 m2/g |
| $PdOTiO_2$ | Thermal decomposition followed by mechanical crushing (**) | 1 micron | 35 m2/g |
| MoS2 | commercial | — | — |

(*)Adams method: a defined quantity of ruthenium salt (e.g. RuCl3.3H2O) is added to sodium nitrate and then heated up to melting at 500° C. for three hours. Ruthenium chloride is then converted into RuO2 and separated from the melted salt. The solid compound thus obtained is then subjected to mechanical crushing. Optionally, the powder may be suspended in sulphuric acid 1-2 N, wherein it is reduced utilizing platinum electrodes and forming thus an unbalanced ruthenium oxide having a higher catalytic activity.

(**)thermal decomposition: a defined quantity of ruthenium trichloride, for example RuCl3.3H2O, or an equivalent quantity of commercial solution, is subjected to a slow drying treatment, first at 80° C. and then at 120° C. The temperature is then raised to 250° C. and the solid compound thus obtained is ground after cooling. The powder is then subjected to thermal decomposition at a temperature comprised between 500 and 700° C. for two hours.

The RuO2 samples thus obtained have been subjected to X-rays diffraction. The samples obtained by the Adams method show only the typical rutile, RuO2, spectrum, while the samples obtained by thermal decomposition appear to be a mixture of RuO2 and a second component which is isomorphous with K2RuC16. The content of this second component decreases by increasing the decomposition temperature and is practically nil at a decomposition temperature of 700° C. The most suitable decomposition temperature appears to be about 600° C., as at higher temperatures the degree of electrocatalytic activity is exceedingly low, while at lower temperatures the coating, when operated as a cathode, tends to loose ruthenium due to both mechanical and electrochemical actions, which is clearly unacceptable. Illustrative data are reported in Example 6.

In a further embodiment of the invention, the conductor, in the form of powder, strands, wires or the like, may be coated with a thin film of electrocatalytic material having low hydrogen overvoltage. For example, silver or tungsten carbide particles may be coated by conventional techniques, such as electroless or galvanic deposition in a fluidized bath, by metals belonging to the platinum group or precursors alloys of Raney nickel or similar materials. The coated particles may be used alone or, according to an embodiment of the invention, in admixture with uncoated particles of said conductor or with particles of low overvoltage material such as ruthenium oxide or other platinum group metal compound in a suitable ratio.

Samples of cathodes bonded to an ion exchange membrane have been prepared utilizing, as the low hydrogen overvoltage component, Raney nickel instead of compounds of metals belonging to the platinum metal group. The relevant data are reported in Example 8.

The leachable component may be commercial aluminum powder, previously subjected to surface oxidation utilizing diluted nitric acid. Material other than aluminum powders may be utilized provided that they are easily leachable. Suitable materials are for example zinc powder, tin powder or alkali metal salts, such as carbonates, sulphates, chlorides and water soluble polymers. In the specific case of alkali metal salts and water soluble polymers, it is obviously necessary to adapt the fabrication process by resorting to formulations based on dry powders. Interesting results have been obtained by utilizing said alternative materials, as illustrated in the following description.

The above described components have been utilized for producing the electrodes according to one of the following procedures, illustrated hereinafter by resorting to practical examples.

PROCEDURE A

The first step consists in preparing a coagulum or paste containing the various components (e.g polytetrafluoroethylene, a conductive platinum group metal compound having a low overvoltage for hydrogen or chlorine such as RuO2, a metal more electroconductive than RuO2 such as silver, and an extractable porosity promoter such as aluminum) in the desired ratio. A suspension of 0.7 g of Algoflon D60 is added to a mixture of 3 g of silver powder, 0.8 g of RuO2 powder and 0.65 g of aluminum powder. The aluminum powder, which has a particle size of 10 to 150 micron—average diameter: 125 micron—is previously oxidized by using dilute nitric acid. The mixture is then homogenized and isopropyl alcohol is added thereto, under suitable stirring. The coagulum (high viscosity phase) is separated from the liquid phase and then applied as a thin film having a thickness of about 100 micron over an aluminum sheet, previously oxidized with dilute nitric acid. After drying at 105° C., sinterization is effected at 320° C. for ten minutes. The coated side of aluminum sheet coated by the sinterized film is then applied onto the cathode side of a Du Pont NX 10119, 140×140 millimeter membrane at 175° C. under a pressure of 50 to 60 kg/cm2 for 5 minutes. minutes. The membrane is then immersed in 15% sodium hydroxide for two hours at 25° C. to completely dissolve the aluminum sheet and the aluminum powder utilized as porosity promoter.

PROCEDURE B

The first step of this procedure consists in preparing a paint having a lower viscosity than the above mentioned coagulum of Procedure A and containing the various components (for example, polytetrafluoroethylene, platinum group material such as RuO2, silver and aluminum) in the desired ratios. For this purpose, a suspension of 0.7 g of Algoflon D60 previously diluted is added to the mixture containing 3 g of silver, 0.8 g of RuO2, 0.65 g of aluminum powder, previously oxidized with dilute nitric acid. After homogenization, 5 grams of methylcellulose or other equivalent material such as cellulose derivates (acetate, ethylate etc.) glucose, lactic and piruvic acids etc. are added to the mixture to avoid coagulation and to obtain a liquid of sufficient viscosity as to applied like a paint. The liquid is then applied by brushing or by other equivalent technique onto an aluminum sheet previously oxidized by dilute nitric acid. The operation is repeated until the desired amount of the noble metal is obtained and then, sinterization is carried out in oven at 340° C. for 1 hour. The preformed sheet thus obtained is then bonded onto the cathodic surface of the membrane at 20–80 kg/cm2, preferably 40–50 kg/cm2 at 175° C., Upon pressing, after mechanically removing the aluminum sheet, the membrane is subjected to alkali leaching treatment in a 15% sodium hydroxide solution for 12–24 hours up to complete solubilization and extraction of the pore-forming agent.

PROCEDURE C

In this third alternative, a suspension of polytetrafluoroethylene, previously diluted is utilized. For example, a Du Pont Teflon T-30 suspension is diluted with distilled water to obtain a final content of 0.1 grams of polytetrafluoroethylene per milliliter (ml) of liquid. Then, 4 ml of this diluted suspension are added to 200 ml of distilled water and heated to reflux. An amount of 1.5 grams of a low overvoltage material such as commercial platinum black powder is then added to the refluxing diluted polytetrafluoroethylene solution. The platinum black powder and the polytetrafluoroethylene coagulate and are separated from the liquid phase by filtering and the filtered coagulum, after drying, is mechanically crushed, broken up and then mixed with about 500 grams of finely powdered solid carbon dioxide. The homogenized mixture is then applied in a uniform layer onto a tantalum sheet. The solid carbon dioxide is sublimated through infrared irradiation and the residue is applied in a uniform layer onto the tantalum sheet and is sinterized at 300°–340° C., preferably at 310°–330° C., for ten minutes. The sintered film is finally applied onto the cathode side of a Du Pont Nafion NX 10119 membrane, under a pressure of 100 kg/cm2, at 175° C. for about 5 minutes.

In the following examples there are described several preferred embodiments to illustrate the invention. However, it should be understood that the invention is not intended to be limited to the specific embodiments.

EXAMPLE 1

Various samples of a coating of the present invention consisting of silver and polytetrafluoroethylene bonded to a Du Pont NX 10119 membrane, were prepared by Procedure A. Tests to verify the electrical resistivity variations over the coating as a function of the ratio between silver and polytetrafluoroethyelene were determined.

The following components were utilized: commercial silver powder having an average diameter of the spheroidal particles of 1 micron and a specific surface (BET) of 1 m2/g, in a quantity sufficient to obtain a load of 100 gr per square meter of membrane surface. Polytetrafluoroethylene (Du Pont Teflon T-30) suspension in a quantity sufficient to obtain the following percentages by weight of the final coating bonded to the ion exchange membrane: 15-35-40%, which correspond to 35-60-70% by volume respectively. Aluminum powder (e.g. produced by Merck-average diameter about 125 microns) previously oxidized with dilute nitric acid, in a weight ratio of 1.5 with respect to the polytetrafluoroethylene weight.

The electrical resistivity of the coating was determined by the four-heads system, with the two central heads connected to a high impedance voltmeter and having a contact surface of 1×10 mm and a distance of 10 mm apart. The resistivity (IR) values, reported in Table 1, are conventionally indicated in ohm/cm.

TABLE 1

Resistivity (IR) of silver/polytetrafluoroethylene coating (100 grams of silver per square meter)

| Silver % by weight | PTFE % by weight | IR ohm/cm |
|---|---|---|
| 60 | 40 | 1.2 |
| 65 | 35 | 0.3 |
| 85 | 15 | 0.04 |

After leaching of aluminum a PTFE content lower than about 10–20% produces a mechanically unstable coating and the lowest electrical resistivity values of the coating bonded to the membrane allow for improved current distribution and reduced cell voltage. Therefore, the following examples are referred to coatings which, after leaching of the porosity promoter, exhibit a content of PTFE of 10–20% by weight.

EXAMPLE 2

Various samples of a coating, containing only a conductor and PTFE particles, bonded to the cathode side of a Nafion NX 10119 membrane, were prepared. After leaching the aluminum powder, the coating exhibited an average content of 10–20% by weight of PTFE. The initial content of aluminum powder before leaching was in a ratio of 1.5 with respect to the PTFE weight. The electrical resistivity of each sample was detected using the same procedure described in Example 1 and the relevant data are reported in Table 2.

TABLE 2

Electrical Resistivity (IR) of the various coating samples containing conductor and polytetrafluoroethylene particles

| Conductor type | Conductor gr/m2 | IR ohm/cm |
|---|---|---|
| Silver | 100 | 0.04 |
| Silver | 150 | 0.04 |
| Nickel | 100 | 5–10 |
| Nickel | 150 | 5–10 |
| Nickel | 200 | 5–10 |
| Copper | 150 | 1 |
| WC (tungsten carbide) | 150 | 15 |
| RuO2 | 200 | 5–8 |
| PdOTiO2 | 200 | 6–10 |
| Platinum Black(*) | 80 | 2–3 |

note: g/m2 = grams per square meter of coating
(*)samples prepared according to the teachings of U.S. Pat. No. 4,224,121 and considered as representative of the prior art.

The data of Table 2 show that the coating resistivity is not only a function of the electrical conductivity of the conductor but it is especially a function of the contact resistivity among the various component particles, depending on the nature and thickness of the superficial oxide film formed at each particle surface. Similar results were obtained with coatings prepared by procedures B and C.

EXAMPLE 3

The samples of Example 2 were subjected to various tests for establishing their resistance to chemical corrosion, which tests consisted of immersion in a sodium hydroxide solution containing hypochlorite (2 g/l as active chlorine) at ambient temperature, for two hours. These tests were aimed to verify the behaviour of the various coating samples under the same conditions which prevail during shut-down of industrial electrolyzers. The electrical resistivity (IR) of each coating sample was detected both before and after each test and after subsequent cathodic polarization in 30% sodium hydroxide. The relevant data are reported in TABLE 3.

TABLE 3

Electrical resistivity (IR) of the various coating samples before and after the tests in solutions containing active chlorine

| CONDUCTOR | | IR (ohm/cm) | | |
|---|---|---|---|---|
| type | gr/m2 | before testing | after testing | after subsequent cathodic polarization |
| Silver | 150 | 0.04 | >20 | 0.06 |
| Nickel | 100 | 5–10 | 100 | 100 |
| Copper | 150 | 1 | >20 | >20 |
| WC (tungsten carbide) | 150 | 15 | 15 | 15 |

The above data clearly show that the coatings based on silver and WC are suitable for industrial applications. In particular, silver undergoes surface corrosion with formation of a chloride or basic chloride film, as the increased electrical resistivity indicates. Under cathodic polarization (as it would occur under real conditions, during start-up operations after a shut-down) this film is re-converted into metal with the electrical resistivity thus returning to the low initial values. WC is completely inert but the observed higher electrical resistivity values clearly indicate that its use in industrial applications would involve a penalty in the cell voltage.

The samples using nickel or copper particles as conductors are subject to irreversible deterioration due to the action of active chlorine or impurities.

EXAMPLE 4

A series of coating samples containing, besides the conductors (silver, nickel, WC), also varying quantities of RuO2 powder as a low hydrogen overvoltage compound of metal belonging to the platinum group (obtained by the Adams method), were prepared following the aforementioned procedure A. The coating was characterized by an average content of PTFE of 10–20% by weight (determined after leaching the aluminum powder, used as porosity promoter, in a ratio of 1.5 times the weight of the PTFE). For comparison purposes, various samples based only on RuO2 and PdOTiO2 were prepared without adding any electrical conductor.

Furthermore, two samples, based on platinum black and PTFE, were prepared according to the teachings of U.S. Pat. No. 4,224,121 and were utilized as conventional reference electrodes. More particularly these two samples were prepared by following the procedures shown in the above patent at page 10 (lines 38–68) and page 11 (lines 1–31) as summarized here below: platinum salt in the form of chloride was mixed with an excess of sodium nitrate or equivalent alkali metal salt and the final mixture was fused in a silica dish at 500°–600° C. for 3 hours. The residue was washed thoroughly to remove the nitrates and halides. The resulting aqueous suspension of oxides was reduced at room temperature using an electrochemical technique, or, alternatively, by bubbling hydrogen through it. The product is dried thoroughly, ground, and sieved through a nylon mesh screen. Usually, after sieving the particles have an average 4 micron diameter. Finally the metal powder was blended with the graphite-Teflon(®) mixture. For all the samples, a cation exchange membrane Du Pont NX 10119 was utilized. The 140×140 mm electrode samples were utilized as cathodes in laboratory cells, under the following conditions: the anode was a titanium expanded sheet having a thickness of 0.5 mm, diamond dimensions 2×4 mm and 140×140 mm as projected in area, activated by a catalytic coating of RuO2-TiO2, obtained by conventional thermal decomposition technique. The cathode was an electrode bonded to the membrane prepared as illustrated in Example 3, abutting against a current distributor constituted by 25 mesh nickel fabric having a wire thickness of 0.2 mm. A resilient compressible nickel wire mat was disposed between the nickel fabric and the electrode samples and exerted pressure, as illustrated in U.S. Pat. Nos. 4,343,690–4,340,452.

The anolyte was brine containing 220 g/l NaCl at 90° C., the catholyte was 33% sodium hydroxide at 90° C. and the current density was 3 kA/m2. The initial voltage values and those after 30 days of operation are reported in Table 4.

TABLE 4

Cell voltage for different cathodes bonded to the cation exchange membrane

| conductor | | platinum group metal compound | | initial voltage | final voltage |
|---|---|---|---|---|---|
| type | g/m2 | type | g/m2 | (Volt) | (Volt) |
| Silver | 150 | — | — | 3.10 | 3.10 |
| Silver | 150 | RuO2 | 1 | 3.00 | 3.00 |
| Silver | 150 | RuO2 | 10 | 2.90 | 2.90 |
| Silver | 150 | RuO2 | 20 | 2.86 | 2.87 |
| Silver | 150 | RuO2 | 30 | 2.85 | 2.86 |
| Silver | 150 | RuO2 | 40 | 2.86 | 2.86 |
| Silver | 150 | RuO2 | 80 | 2.86 | 2.88 |
| Nickel | 200 | — | — | 3.07 | 3.05 |
| Nickel | 200 | RuO2 | 40 | 2.98 | 3.00 |
| Nickel/Silver | 190/10 | RuO2 | 40 | 2.98 | 2.98 |
| Nickel/Silver | 180/20 | RuO2 | 40 | 2.95 | 2.95 |
| Nickel/Silver | 150/50 | RuO2 | 40 | 2.92 | 2.95 |
| Nickel/Silver | 100/50 | RuO2 | 40 | 2.95 | 2.95 |
| WC | 150 | — | — | 3.01 | 3.01 |
| WC | 150 | RuO2 | 40 | 3.00 | 3.00 |
| WC | 150 | RuO2 | 100 | 3.00 | 3.00 |
| WC | 150 | RuO2 | 150 | 2.95 | 2.95 |
| WC | 150 | RuO2 | 200 | 2.95 | 2.95 |
| WC | 150 | PdOTiO2 | 100 | 2.98 | 3.05 |
| WC | 150 | PdOTiO2 | 150 | 2.95 | 3.00 |
| WC | 150 | PdOTiO2 | 200 | 2.95 | 3.00 |
| | | RuO2 | 200 | 3.01 | 3.01 |
| | | PdOTiO2 | 200 | 3.05 | 3.06 |
| Silver | 150 | Platinum black | 10 | 2.87 | 2.87 |
| Silver | 150 | Platinum black | 20 | 2.84 | 2.85 |
| | | Platinum black(*) | 40 | 2.95 | 2.96 |
| | | Platinum | 80 | 2.92 | 2.93 |

TABLE 4-continued

| Cell voltage for different cathodes bonded to the cation exchange membrane | | | | | |
|---|---|---|---|---|---|
| conductor | | platinum group metal compound | | initial voltage | final voltage |
| type | g/m2 | type | g/m2 | (Volt) | (Volt) |
| | | black(*) | | | |

(*)samples prepared according to the teachings of U.S. Pat No. 4,224,121 and considered as representative of the prior art. Partial detaching of the coating from the membrane was observed in limited areas. The above results clearly show that when silver is utilized as the conductor a load of 10 gr/m2 of RuO2 or platinum black is sufficient to ensure an improved cell voltage 0.2 V lower than the voltage obtained by utilizing silver alone. When utilizing nickel as the conductor, an increased cell voltage with respect to silver, 0.1 to 0.12 higher, was detected even if silver was added, confirming thus the superiority of silver over nickel and the important role played by the electrical resistivity of the coating, which has to be as low as possible.

When utilizing WC as the conductor, the cell voltage was increased by about 0.15 volts with respect to silver, which constitutes a further confirmation of the importance of the coating electrical resistivity. When utilizing RuO2 alone or PdOTiO2 alone, without silver, the cell voltage results increased by about 0.1 V even if higher loads of noble metals (for example 200 gr/m2) were introduced. The electrical resistivity of coatings based only on RuO2 or on PdOTiO2 appeared to fall in the range of 5–10 ohm/cm.

When utilizing coatings based on mixtures of conductors and platinum group metal compounds, the same cell voltages were obtained as with conventional coatings of the art but a lower load of noble metal per square meter was possible. In the particular case of RuO2-silver and of platinum black-silver mixtures, a 0.1 volt, lower cell voltage was measured utilizing a noble metal load of 10–20 g/m2. The minimum load required according to the state of the art technique was 40–80 g/m2).

Samples prepared according to the state of the art technique, (last two items of Table 4), for comparison purposes showed that soon after 30 days of operation an initial detaching of the coating from the membrane was experienced. The coating samples according to the present invention remained unimpaired.

EXAMPLE 5

Coating samples were prepared by varying the aluminum powder content, while the content of silver (150 g/m2), RuO2 (40 g/m2 by the Adams method) and PTFE (10% of the final weight detected after leaching the aluminum powder) remained the same. These tests were intended to ascertain the role played by the coating porosity. All of the samples were prepared following the procedure B. The samples were tested under the same electrolysis conditions as described in Example 4 and the results are reported in the following Table 5.

TABLE 5

| Cell voltage for cathodes bonded to a cation exchange Du Pont NX 10119 membrane as a function of the coating porosity | | |
|---|---|---|
| Ratio by weight Aluminum/polytetrafluoroethylene | initial cell voltage (Volt) | final cell voltage after 30 days (Volt) |
| 0.48 | 3.07 | 3.33 |
| 0.87 | 2.90 | 2.90 |
| 1.11 | 2.87 | 2.87 |
| 1.50 | 2.85 | 2.86 |

TABLE 5-continued

| Cell voltage for cathodes bonded to a cation exchange Du Pont NX 10119 membrane as a function of the coating porosity | | |
|---|---|---|
| Ratio by weight Aluminum/polytetrafluoroethylene | initial cell voltage (Volt) | final cell voltage after 30 days (Volt) |
| 1.76 | 2.85 | 2.88 |
| 2.01 | 2.91 | 3.03 |

The above data clearly show that the optimum weight ratio between aluminum and PTFE is about 1.5. Below this ratio, the porosity is unsufficient to grant a complete exploitation of the RuO2 due to lower active area and lower mass transfer of both reagents and products through the catalytic layer, while higher ratios tended to provide for less mechanically stable structures and for an increased electrical resistivity (0.08 ohm/cm versus 0.05 ohm/cm).

While preparing the above samples, various layers without the aluminum powder were prepared. After sinterizing at 340° C., pressing at 20–80 kg/cm2 at 160°–180° C., after leaching of the aluminum sheet by dissolution in 10% caustic soda at ambient temperature, the pore diameters of these samples were measured. The pores diameters were comprised in a range between 0.05 and 1 micron, with an average value of 0.1–0.3 micron depending partially on the production parameters (pressure and temperature).

EXAMPLE 6

Coating samples were prepared to determine the effect of different types of RuO2 on the cell voltage. All the samples were prepared by Procedure B utilizing the following quantities of material:

RuO2: 40 g/m2

Silver: 150 g/m2

PTFE: 15% of the final coating weight aluminum powder: 1.5 times the PTFE weight Du Pont Nafion 10119 membranes were utilized and the following RuO2 types were utilized:

(a) RuO2 obtained by the Adams method (b) RuO2 obtained by thermal decomposition at 500° C., consisting of a mixture for 50% of rutile RuO2 and 50% of a compound which is isomorphous with K2RuC16 (determined by x-rays diffraction)

(c) RuO2 obtained by thermal decomposition at 600° C. and consisting of a mixture for 70% of rutile RuO2 and 30% of said isomorphous compound.

(d) RuO2 obtained by thermal decomposition at 700° C., consisting 100% of rutile RuO2.

(e) RuO2 obtained by chemical oxidation at 40° C. via the hydrogen peroxide route, of commercial Ru metal powder.

(f) RuO2 obtained by thermal decomposition at 450° C., in the presence of hydroxylamine as oxidizing controlling agent, consisting of a mixture of 35% of rutile RuO2 and 65% of a compound isomorphous with K2RuC16.

All the above RuO2 types, after preparation, were submitted to the final crushing to obtain the product in a desired powder form (1 micron). The coating samples were tested under the same electrolysis conditions as illustrated in Example 4 and the relevant data are reported in Table 6.

TABLE 6

| RuO2 type | Cell voltage as a function of the RuO2 type: active surface area (BET, m2/g) | initial cell voltage (Volt) | final cell voltage after 10 days (Volts) |
|---|---|---|---|
| (a) Adams, 500° C. | >80 | 2.86 | 2.86 |
| (b) thermal, 500° C. | 1.5 | 2.80 | 3.15(*) |
| (c) thermal, 600° C. | 1.1 | 2.82 | 2.83 |
| (d) thermal, 700° C. | 1.0 | 2.98 | 2.98 |
| (e) thermal with NH2OH, 450° C. | 5.4 | 2.79 | 2.80 |
| (f) chemical | 1.6 | 2.87 | 3.09(**) |

(*)ruthenium loss and detaching of the coating after 10 days operation
(**)ruthenium loss and detaching of the coating after 6 days operation.

The above demonstrated that RuO2 obtained by thermal decomposition was noticeably more catalytic than the types obtained by the Adams and chemical methods, notwithstanding its lower specific surface (1.5 m2/g versus 80 m2/g). The failure of the samples prepared at 500° C. (thermal method) was due to a incomplete oxidation of the precursor ruthenium salt (RuC13.3H20) to the desired final product (RuO2). The failure of the sample prepared by the chemical method was attributed to the surface oxidation of the metallic ruthenium powder which was unstable in concentrated caustic solutions in the presence of active chlorine diffusing through the membrane from the anode to the cathode side during shut down conditions. The surprising better behaviour of the sample prepared at low temperature (450° C.), in respect to the one obtained at 500° C., is ascribed to the role played by NH20H which leads to the complete oxidation of the ruthenium salt more effectively than oxygen gas.

EXAMPLE 7

Various samples, prepared by Procedure A and containing silver (150 g/m2), RuO2 (by the Adams method—30 g/m2), PTFE (15% of the final coating weight, after leaching the aluminum powder utilized in a ratio of 1.5 parts for each part of PTFE), were tested under the same electrolysis conditions illustrated in Example 4, except for the alkali metal concentration and current density.

The most characterizing data are reported in the following Table 7.

TABLE 7

| a,% | b,kA/m2 | initial Volts | final Volts | operating time(days) | current efficiency percent | Kwh/ton NaOH |
|---|---|---|---|---|---|---|
| 33 | 3 | 2.86 | 2.86 | 108 | 95 | 2021 |
| 37 | 3 | 2.95 | 2.96 | 103 | 95 | 2086 |
| 47 | 3 | 3.13 | 3.14 | 85 | 94.5 | 2209 |
| 33 | 4 | 2.98 | 3.00 | 110 | 95 | 2122 |
| 37 | 4 | 3.12 | 3.13 | 30 | 95 | 2212 |
| 47 | 4 | 3.27 | 3.29 | 30 | 94.5 | 2335 |
| 33 | 5 | 3.14 | 3.15 | 10 | 94.5 | 2236 |
| 37 | 5 | 3.28 | 3.29 | 10 | 94.5 | 2335 |
| 47 | 5 | 3.45 | 3.45 | 10 | 94 | 2457 |

Cell voltages for cathodes bonded to a Du Pont Nafion (R) NX 10119 membrane as a function of the sodium hydroxide concentration (a) and current density (b)

The above data clearly show that the cathodes of the invention can undergo high current densities without any mechanical damage and further provide an efficient performance even when in contact with remarkably concentrated sodium hydroxide solution, which are forbidden in the conventional zero-gap, narrow gap or finite gap cells. This unexpected behaviour may be ascribed to the particular nature of the cathodes bonded to ion exchange membranes described in the invention. These cathodes in fact are characterized by a porous, capillary internal structure wherein the evolution of hydrogen gas bubbles inside the pores and the release of said bubbles towards the aqueous sodium hydroxide solution may completely eliminate the concentration polarization phenomena, which are typical of the other conventional processes.

EXAMPLE 8

Various samples of cathodes bonded to an ion exchange Nafion NX 10119 membrane, were prepared by procedure A utilizing the most advantageous ratios but substituting the electrocatalytic platinum group metals compounds with Raney nickel, produced by Carlo Erba, Italy. These samples were characterized by PTFE (Algoflon D60—Montefluos, Italy): 15% by weigh aluminum powder: 1.5 parts for each PTFE part After leaching the aluminum powder, the samples were tested under the same electrolysis conditions illustrated in Example 4 and the relevant data are reported in the following Table 8.

TABLE 8

| Silver g/m2 | Raney Nickel g/m2 | initial Volts | final voltage Volts |
|---|---|---|---|
| — | 100 | 3.00 | 2.10 |
| 150 | 30 | 2.95 | 2.95 |
| 150 | 40 | 2.90 | 2.90 |

Cell voltage for cathodes bonded to cation exchange membranes without electrocatalysts based on platinum group metals The above results clearly indicated that silver, which substantially reduces the coating resistivity, permits a more efficient exploitation of the low hydrogen overvoltage electrocatalysts, not only of those based on the platinum group metals. These last ones, however, are the most preferred, compared with electrocatalyst based on Raney nickel or similar because of their higher resistance to active chlorine attack (during shut down operations) and to poisoning by iron or heavy metal traces, which may be contained in the sodium hydroxide.

EXAMPLE 9

Four cathodes, identified as samples A, A' and samples B, B', bonded to a Dupont Nafion(R) NX 10119 membrane, were prepared according to "procedure B". The final coating compositions, after leaching the aluminum powder, were as follows:

| sample | coating composition (g/m2) RuO2 | Ag | Pt | PTFE |
|---|---|---|---|---|
| A | — | 50 | 12 | 8 |
| A' | | | | |
| B | 12 | 50 | — | 8 |
| B' | | | | |

The samples, 140×140 mm, were operated, initially for 15 days, in commercially pure catholytes (A and B) and subsequently, again for the same period of time, in contaminated catholytes containing impurities such as iron or mercury compounds (A' and B'). The working conditions and the electrochemical performance of the above samples are reported in Table 9.

TABLE 9

| sample | Voltage in pure catholyte(*) inital | 15 days | Voltage in contaminated catholyte(*) inital | 15 days | impurities type | ppm |
|---|---|---|---|---|---|---|
| A | 2.85 | 2.86 | 2.85 | 3.88 | Hg | 5 |
| A' | 2.85 | 2.85 | 2.86 | 2.99 | Fe | 50 |
| B | 2.86 | 2.86 | 2.85 | 2.87 | Hg | 5 |
| B' | 2.85 | 2.85 | 2.86 | 2.87 | Fe | 50 |

(*)temperature: 90° C.
anolyte: NaCl 200 g/l ph 3.5
cathode current density: 3 kA/m2
catholyte: NaOH 32%

From these experimental results it can be concluded that metallic platinum and ruthenium dioxide behave quite similarly in commercially pure electrolyte and ruthenium dioxide performs better than metallic platinum in contaminated catholyte.

EXAMPLE 10

A series of samples having varying thicknesses of the coating, bonded to a bilayer ion exchange membrane 150 micron thick, were prepared following procedure B. The following were utilized: (a) RuO2 (Adams method) in a quantity equal to 18% of the final coating weight, (b) PTFE 10% of the final coating weight, (c) commercial silver 72% of the final coating weight, (d) aluminum powder in a ratio of 1.5 parts for each PTFE part. The samples were tested under the same electrolysis conditions as in Example 4 and the relevant results are reported in the following Table 10.

TABLE 10

Cell voltage for cathodes bonded to a bilayer cation exchange membrane 150 microns thick, as a function of the coating thickness

| silver g/m2 | RuO2 g/m2 | polytetra-fluoro-ethylene g/m2 | thickness micron | initial voltage Volts | final voltage after 30 days Volts |
|---|---|---|---|---|---|
| 150 | 37 | 21 | 100 | 2.86 | 2.86 |
| 75 | 18 | 10 | 50 | 2.88 | 2.87 |
| 50 | 12 | 7 | 30 | 2.82 | 2.85 |
| 30 | 8 | 4 | 20 | 2.83 | 2.84 |

The above results show that the same performances or even better ones were obtained with very thin coatings and thus with lower silver loads and particularly with lower noble metal loads per square meter of membrane surface. In any case the coating composition and process for preparing said samples are to be maintained within the most preferred conditions already defined in the preceding examples.

EXAMPLE 11

Various cathodes bonded to three different types of membranes were prepared according to procedure B.

The final coating composition, after leaching the aluminum powder, was as follows: RuO2: 12 g/m2, silver: 50 g/m2 and PTFE: 8 g/m2. The following membrane types were utilized: Du Pont Nafion 902 bilayer sulphocarboxylic, reinforced membrane having a thickness of 250 microns; Du Pont Nafion NX10119 bilayer sulphocarboxylic, unreinforced membrane having a thickness of 150 microns; experimental, bilayer sulphocarboxylic unreinforced membrane, having a thickness of 80 microns and experimental, bilayer, carboxylic, unreinforced membrane, having a thickness of 65 microns. The samples, 140×140 mm, were tested under the same electrolysis conditions illustrated in Example 4. The relevant data are reported in the following Table 11.

TABLE 11

Cell voltage for cathodes bonded to different cation exchange membranes

| membrane type | thickness (micron) | initial voltage (Volts) | final voltage after 10 days (Volts) |
|---|---|---|---|
| reinforced | 250 | 3.02 | 3.05 |
| un-reinforced | 150 | 2.85 | 2.85 |
| un-reinforced | 80 | 2.72 | 2.72 |
| un-reinforced | 65 | 2.68 | 2.69 |

As expected, the reinforced membrane, whose utilization is unavoidable in a conventional electrolyzer, utilizing the zero-gap, narrow gap or finite gap technology, provides for higher voltages, due to the greater thickness and to the presence of internal reinforcement (fabric or dispersed fibers). The possibility to use unreinforced membranes, which are characterized by remarkably lower voltages, is particularly advantageous for the technology based on bonding of the electrodes, particularly cathodes, of the present invention. In fact, the electrode bonded to the membrane represents an efficient reinforcement which provides for mechanical stability and easy handling of the membrane otherwise bound to being ruptured under mechanical stresses during operation (pressure pulsations, pressure differentials between anode and cathode compartments). This surprising result constitutes one of the substantial innovative steps of the present invention.

EXAMPLE 12

Various cathodes were prepared according to Procedure A to obtain a PTFE average content of 10–20% by weight (determined after leaching of the aluminum powder used as porosity promoter, in a ratio of 1.5 times the weight of PTFE).

The following conductive and electrocatalytic particles were utilized:

silver powder (commercial, Johnson & Matthey)

silver powder (as above), coated with RuO2 obtained by soaking in an aqueous solution of RuC13.3H20, carefully draining and slowly drying at 80° C. and then at 120° C. and increasing the temperature up to 600° C. for about 1 hour. The procedure was repeated as many times as to obtain a quantity of deposited ruthenium dioxide of 10% (as ruthenium) with respect to the silver powder weight.

nickel powder obtained by thermal reduction with NaBH4, electroplated with metal silver from an alkali galvanic bath wherein the nickel powder was kept as a fluidized bed around a current feeder consisting of a platinum gauze. The deposited silver was about 8% by weight of the nickel powder.

RuO2 powder prepared according to the Adams method.

The samples thus prepared were utilized under the same conditions illustrated in Example 4. The results are reported in Table 12.

TABLE 12

| Conductor | | Electrocatalyst | | Voltage 30 days of |
|---|---|---|---|---|
| type | g/m2 | type | g/m2 | operation (V) |
| Silver | 150 | RuO2-coated silver | 50 | 2.90 |
| Silver-coated nickel | 200 | RuO2 (Adams method) | 40 | 2.89 |

The results of Table 12 shows that the load of noble metal per square meter may be remarkably reduced (e.g. 5 g/m2) without spoiling the cathode performance. Further, the appreciable results obtained by nickel particles coated with silver indicate that the electrical resistivity in the surface contact between the single particles is more important than the bulk electrical resistivity.

EXAMPLE 13

A cathode, prepared by procedure A, was bonded to a 130 micron thick, anion exchange membrane (Asahi Glass, Selemion (R), CMV/CMR type) and the coating composition, after leaching the aluminum powder utilized in a ratio of 1.5 part for each PTFE part, was as follows:

RuO2: 12 g/m2 silver: 50 g/m2

PTFE (Algoflon D60— Montefluos, Italy): 8 g/m2

The sample, 100×1000 mm, was tested for water electrolysis, under the following conditions: anode was nickel expanded sheet—0.5 mm thick, diamond dimensions 2×4 mm and the membrane-cathode assembly was in contact with the anode and pressed thereto by a resilient compressible nickel wire mat. The current distributor was 25 mesh nickel fabric (wire thickness 0.2 mm) interposed between the cathode bonded to the membrane and the nickel mat. The anolyte and catholyte were 25% KOH at 80° C. and the current density was 3 KA/m2.

For comparison purposes, a similar cell was provided with an un-bonded cathode constituted of an expanded nickel sheet having a thickness of 0.5 mm and activated by a galvanic coating of nickel containing RuO2 particles dispersed therein. The voltage detected with the bonded cathode was 1.9 V, while the voltage detected with the un-bonded cathode was 2.05 V.

EXAMPLE 14

A cathode prepared by Procedure A was bonded to a sulphonic cation exchange membrane Dupont Nafion (R) 120–200 micron thick. The coating composition, after leaching the aluminum powder utilized in a ratio of 1.5 parts for each PTFE part, was as follows:

RuO2: 12 g/m2

Ag: 50 g/m2

PTFE: 8 g/m2 (suspension of Algoflon D60).

The sample, 100×1000 mm, was tested for water electrolysis under the conditions described in Example 13. In addition, the electrolytic cell was equipped with a chamber for mixing the degased anolyte and the catholyte together, in order to counterbalance the polarization of concentration created by the cationic membrane and to allow for feeding the anodic and cathodic compartments with the same electrolytes.

A similar cell was provided with an un-bonded cathode comprising an expanded nickel sheet having a thickness of 0.5 mm and activated by galvanic coating with nickel containing RuO2 particles dispersed therein. The voltage detected with the bonded cathode was 1.96, whereas the one with the un-bonded cathode was 2.11.

Summarizing and as shown by the above example, the invention herein contemplated involves several embodiments which may be separately used or used in combination thereof.

Electroconductivity of the electrode bonded to the diaphragm is improved by incorporating an electroconductive material in addition to the electrocatalyst for electrolysis (Platinum group metals, oxides or other compounds). This effectively improves the electroconductivity of the electrode layer or coating in an edgewise direction. When the electrocatalyst is a metal compound (RuO2 or the like), the electroconductivity of the added material is substantially greater that the electrocatalyst. This may be true even when platinum metal is used as electrocatalyst. Generally, the amount of electroconductive material added should be enough to provide a layer or coating having a surface resistivity not more than about 2 ohms per centimeter, advantageously below 1 ohm per centimeter and preferably as low as 0.5 ohms per centimeter or lower.

Ruthenium oxide and like conductive compounds of platinum group metals are sufficiently electroconductive to function effectively as an electrode as they are commonly used in thin films and the electrolyzing current need only flow through the film thickness (a distance rarely over 200 microns). By incorporating a further electroconductor having greater electroconductivity than the platinum group metal compound particles, the conductivity in direction from edge to edge of the thin film or surface is substantially improved. This increases the overall life of the electrode layer and permits more uniform current distribution thereby avoiding establishment of localized areas where current flow is unduly high.

Even where platinum group metals or Raney nickel are used as the electrocatalyst, such improved results are observed by their use along with electroconductive metal usually having a higher hydrogen overvoltage than the electrocatalyst such as metallic silver or copper, silver coated copper or nickel metal or other highly conductive stable metal which has electroconductivity substantially equal to that of silver or copper metal. Thus, Table 4 shows that similar voltages were attained with 150 g/m2 of silver and only 20 g/m2 of platinum as was obtained with 40 and 60 grams/per square meter or platinum without silver.

The conductive particles also stiffen and effectively reinforce the ion exchange diaphragm and such reinforcement can be improved by incorporation of elongated particles such as metallic strands or fine wires having the diameter of metal wool into the electrode layer.

As shown in Example 12, the electrode may comprise two layers bonded to each other by the binder or the like with one porous layer comprising the relatively high overvoltage electroconductive particles such as silver metal etc. with little or no electrocatalyst (Pt group metal or oxide, carbide, etc. or Raney Nickel) and the other layer containing the electrocatalyst (RuO2 or the like) and the higher overvoltage electroconductor. In this case, the high overvoltage layer is bonded to the ion exchange diaphragm. The effect of this structure is to reduce to some degree electrolysis and gas evolution at the interface between the electrode and the diaphragm and promote greater electrolysis at areas spaced from the diaphragm surface. This serves to reduce overall overvoltage between anode and cathode in the course of the electrolysis.

In some cases, the additional electroconductor may even be omitted from the second layer containing the electrocatalyst where the two layers are bonded or in intimate contact. However, best results are generally obtained when both layers contain the additional electroconductor.

It is also possible to obtain effective electrodes wherein the electroconductive silver, copper, nickel or the like is coated with a thin surface coating of platinum group metal or Raney Nickel provided the density of particles is high enough to provide an electrode having the desired surface resistivity below about 2 ohms per centimeter.

The electrode disclosed herein is preferably directly bonded to the ion exchange diaphragm. However such diaphragm frequently comprises two or more superimposed coatings or layers, one of which may comprise a cation or anion exchange material and another of which may comprise a coating or other layer or surface. The invention herein contemplated may be effectively performed where the electrode herein described is bonded to either layer or surface of the multilayer diaphragm. In one case, the electrode layer or layers may be bonded directly to an ion exchanging surface.

Alternatively, it may be spaced from such surface by bonding it to the coating or other surface of the diaphragm having no or lower ion exchange capability.

The amount of added higher overvoltage conductor such as silver usually is at least equal to the weight per square meter of low overvoltage material in the electrode layer and generally is in excess of the amount. Such amounts provide effective reinforcement of the ion exchange diaphragm when the electrode layer or coating is bonded to the diaphragm either directly or through intermediate layers. Especially superior reinforcement may be achieved where the average particles size of the electroconductive particles is well below one micron for example 0.1 micron or less.

Various modifications of the cathodes and cells and processes of the invention may be made without departing from the spirit or scope thereof and it is to be understood that the invention is intended to be limited only as defined in the appended claims.

What we claim is:

1. An electrode ion-exchange unitary assembly comprising a layer or coating of electrocatalytic and electroconductive particles bonded together on an ion-exchange membrane by sintering with an electrolyte-resistant, hydrophobic, fluorinated polymeric binder, said layer or coating having relatively small pores dispersed therethrough and a plurality of relatively larger channels larger than the small pores and of 10 to 150 microns and communicating therewith, extending from the exterior of the layer or coating into the interior of the layer or coating.

2. The unitary assembly of claim 1 wherein the larger channels are produced after formation of the layer or coating.

3. The unitary assembly of claim 1 wherein the larger channels are produced by leaching of leachable particles from the layer or coating after its formation.

4. The unitary assembly of claim 1 wherein at least part of said larger channels extends between the layer or coating surfaces in an edge direction.

5. The unitary assembly of claim 1 wherein said small pores have an average diameter of at least 0.1 micron.

6. The unitary assembly of claim 1 wherein the average diameter of the channels is at least 5 times the average diameter of said pores.

7. The unitary assembly of claim 1 wherein the average diameter of said larger channels is substantially larger than the average size of said electrocatalytic and electroconductive particles.

8. The unitary assembly of claim 1 wherein said binder comprises polytetrafluoroethylene particles sinterized together.

9. The unitary assembly of claim 1 wherein said electocatalytic and electroconductive particles are in sufficient amount to reinforce the ion-exchange membrane.

10. The unitary assembly of claim 1 wherein the surface resistivity is below 2 ohms per centimeter, as measured by the procedure of Example 1.

11. The unitary assembly of claim 1 wherein said layer or coating is a cathode.

12. The unitary assembly of claim 11 wherein the electroconductive particles have electroconductivity substantially equal to that of metallic silver particles.

13. The unitary assembly of claim 11 wherein the electroconductive particles are metallic silver particles.

14. The unitary assembly of claim 11 wherein the electroconductive particles are silver-coated electroconductive particles.

15. The unitary assembly of claim 11 wherein the electocatalytic particles are platinum group metal particles.

16. The unitary assembly of claim 11 wherein the electocatalytic particles are platinum group metal compound particles.

17. The unitary assembly of claim 11 wherein the electrocatalytic particles are platinum group metal coated particles.

18. The unitiary assembly of claim 11 wherein the electrocatalytic particles are particles coated with platinum group metal compound.

19. An electrolytic cell comprising the unitary assembly of claim 1.

20. A method of generating chlorine comprising electrolyzing an aqueous alkali metal chloride solution in the electrolytic cell of claim 19.

21. An electrode ion-exchange unitary assembly comprising an ion-exchange membrane with a cathode layer or coating comprising electrocatalytic ruthenium dioxide particles and electroconductive silver particles bonded to the membrane by sintering with a hydrophobic fluorinated polymeric binder whereby the cathode layer or coating has a plurality of relatively small pores dispersed therethrough and a plurality of relatively larger channels with respect to the small pores of 10 to 150 microns and communicating with the small pores, the channels extending from the exterior of the layer or coating into the interior of the layer or coating.

* * * * *